US005523536A

United States Patent [19]

Binder et al.

[11] Patent Number: 5,523,536

[45] Date of Patent: Jun. 4, 1996

[54] MULTI-POLE VACUUM SWITCH WITH A POLE OPERATING UNIT FOR EACH VACUUM SWITCHING TUBE

[75] Inventors: Manfred Binder; Werner Gruner; Detlev Schmidt; Ralf Seebold; Norbert Steinemer, all of Berlin, Germany

[73] Assignee: Siemens Aktiengesellschaft, Munich, Germany

[21] Appl. No.: 211,364

[22] PCT Filed: Jun. 11, 1992

[86] PCT No.: PCT/DE92/00785

§ 371 Date: May 25, 1994

§ 102(e) Date: May 25, 1994

[87] PCT Pub. No.: WO93/07635

PCT Pub. Date: Apr. 15, 1993

[30] Foreign Application Priority Data

Sep. 30, 1991 [DE] Germany ..... 41 33 092.7

[51] Int. Cl.[6] ..... H01H 33/66

[52] U.S. Cl. ..... 218/120; 218/140

[58] Field of Search ..... 218/7, 14, 118, 218/120, 134, 139, 140, 154, 155

[56] References Cited

U.S. PATENT DOCUMENTS

| | | | |
|---|---|---|---|
| 4,713,503 | 12/1987 | Kamp | 200/144 B |
| 5,422,450 | 6/1995 | Miyazawa et al. | 218/140 |

FOREIGN PATENT DOCUMENTS

| | | | |
|---|---|---|---|
| A20172986 | 3/1985 | European Pat. Off. | H01H 33/66 |
| A10387635 | 3/1990 | European Pat. Off. | H01H 33/66 |
| A20397294 | 5/1990 | European Pat. Off. | H01H 33/66 |
| A13330979 | 1/1984 | Germany | H01H 33/66 |
| A13414016 | 10/1985 | Germany | H01H 33/66 |

*Primary Examiner*—J. R. Scott
*Assistant Examiner*—Michael A. Friedhofer
*Attorney, Agent, or Firm*—Kenyon & Kenyon

[57] ABSTRACT

A multi-pole vacuum switch which has, for each vacuum switching tube, a pole operating unit with a lever arrangement for changing the direction of movement produced by a drive device. Two toggle levers are arranged in a casing of the pole operating unit. A first toggle lever is connected to the operating plunger of the vacuum switching tube and the second toggle lever is connected to a supporting lever. The supporting lever acts on a contact pressure spring via a pull rod. In the switched-on position (where the switch is closed), the first and second toggle levers are close to dead center. An adjustment device permits the toggle levers to be adjusted relative to the supporting lever.

5 Claims, 3 Drawing Sheets

Figure 1:
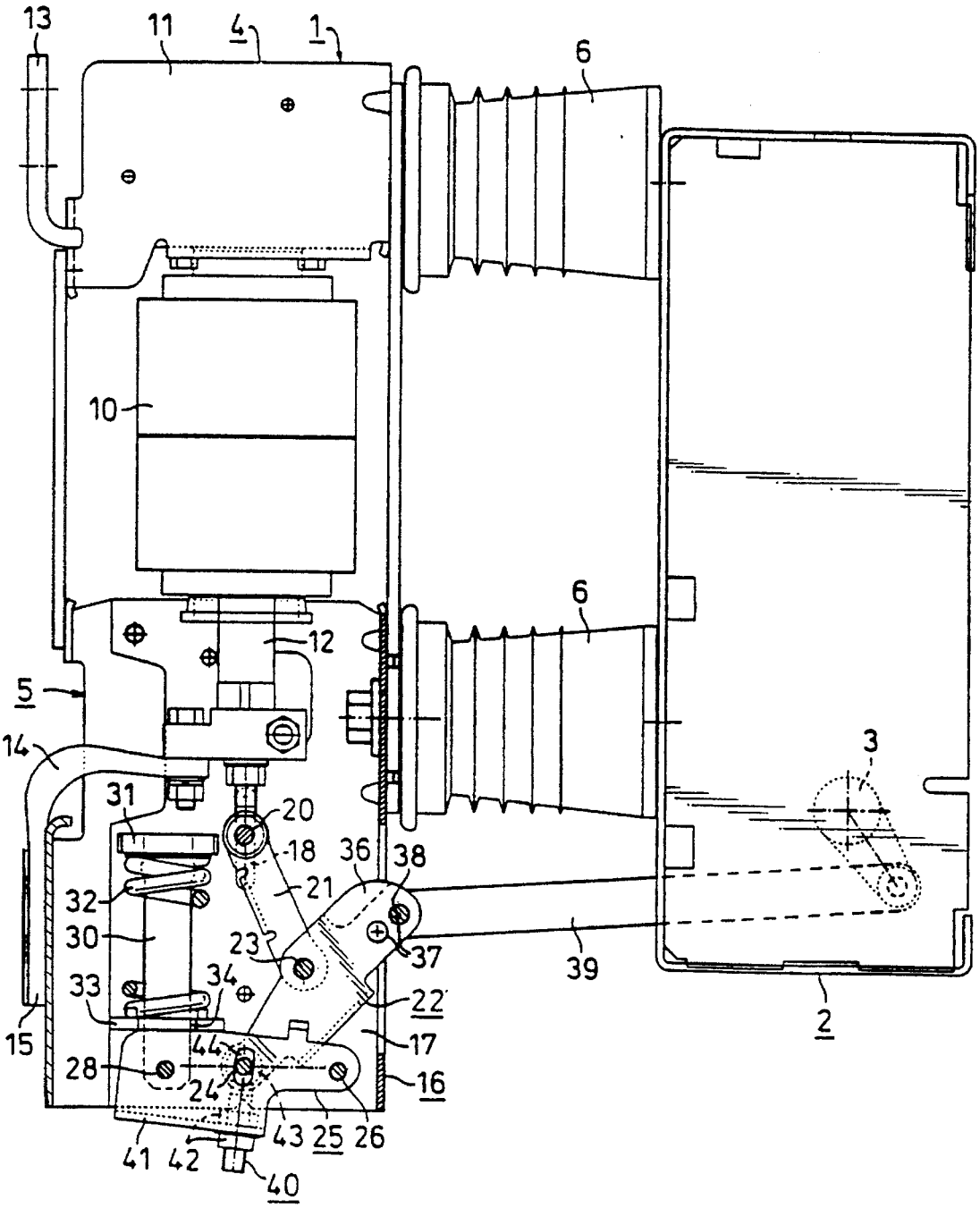

MULTI-POLE VACUUM SWITCH WITH A POLE OPERATING UNIT FOR EACH VACUUM SWITCHING TUBE

The invention relates to a multi-pole vacuum switch with, for each pole, a vacuum switching tube which has a linearly movable operating plunger, and with a pole operating unit which is assigned to each vacuum switching tube, the pole operating unit having a lever arrangement for changing the direction of the operating force provided by a drive device which is common to all poles, on the operating plunger, and a contact force spring which is arranged approximately parallel to the direction of movement of the operating plunger, as well as a casing which supports the lever arrangement and the contact force spring.

A vacuum switch of this kind has been disclosed in DE-A-34 14 016. The properties of the vacuum switch described there include the drive device being loaded by the contact forces of all the poles when the vacuum switching tubes are switched on. These forces are transmitted in a known manner by the lever arrangement via an insulating coupling rod to the drive device and must be supported there. The invention is based on the object of reducing the stressing of the drive device by the reaction of the contact forces. At the same time, displacement of the contact force springs is to be avoided overall during the switching-on and switching-off by means of a single-side secure support, such as is known per se (cf. DE-A-33 00 979).

This object is achieved according to the invention in that the lever arrangement comprises two toggle levers, one of which is connected in an articulated fashion to the operating plunger of the vacuum switching tube and the other of which is connected in an articulated fashion to a supporting lever which is pivotably mounted at one of its ends on the casing and which is connected at its other end to the contact force spring, the supporting lever assuming in its position of rest a position which extends approximately at right angles to the direction of movement of the operating plunger and the toggle levers being close to their extended position in the ON position of the vacuum switch.

By means of the specified arrangement of the toggle levers, it is ensured that the greater part of the reaction of the contact force springs in each pole is supported in the lever arrangement itself and in particular in the casing which receives the lever arrangement. The drive device of the vacuum switch and the parts which serve to transmit the operating force to the pole operating unit are thus largely relieved of mechanical loading. This load relief occurs irrespective of whether the toggle levers are in the pre-extended position or the overextended position. In the switching processes, the contact force spring is not moved as a whole but rather can be supported fixedly at one end since a connection to the supporting lever which is part of the lever arrangement is only required at the opposite end.

According to a further development of the invention, the toggle lever which is connected to the supporting lever can be extended beyond the toggle joint and the protruding lever part which is formed in this way can be constructed as a coupling point with an insulating coupling rod which connects the drive device to the pole operating unit. As a result, on the one hand the connection of the coupling rod to the pole operating unit is made easier because the toggle joint bolt has no further function to perform apart from connecting the toggle levers. On the other hand, by suitably selecting the length of the protruding lever part, it is possible to influence the transmission ratio of the lever arrangement.

The protruding lever part can have at least two through-openings, which are arranged at different distances from the end of the toggle lever which is connected to the supporting lever, for the optional insertion of a coupling bolt, by means of which the drive device is connected to the pole operating unit. In this way, the transmission ratio of the lever arrangement can be easily changed with the same movement of the drive device if, for example, a vacuum switching tube with a larger or smaller switching displacement is to be used with an otherwise unchanged overall arrangement.

The articulated connection of one toggle lever to the supporting lever can be of adjustable construction; for this purpose, an elongated hole for guiding an articulation bolt, an eye bolt which is penetrated by the articulation bolt and nuts which determine the position of the eye bolt with respect to the supporting lever can be provided in the supporting lever. This arrangement has the advantage of good accessibility of the parts which are provided for adjusting the articulated connection because the supporting lever, as already mentioned, assumes in its position of rest a position which extends approximately at right angles to the direction of movements of the operating plunger. The parts which are required for adjustment are therefore accessible approximately :in the axial extent of the vacuum switching tube on the underside of the pole operating unit.

A convenient arrangement of the contact force spring in the pole operating unit is to be achieved by arranging a transverse element in the casing as counterbearing of the supporting lever in its position of rest and at the same time as counter-bearing for one end of the contact force spring which is constructed as a helical compression spring, the said transverse element being provided with a through-opening for a pull rod which connects the opposite end of the contact force spring to the supporting lever.

Figure 2:
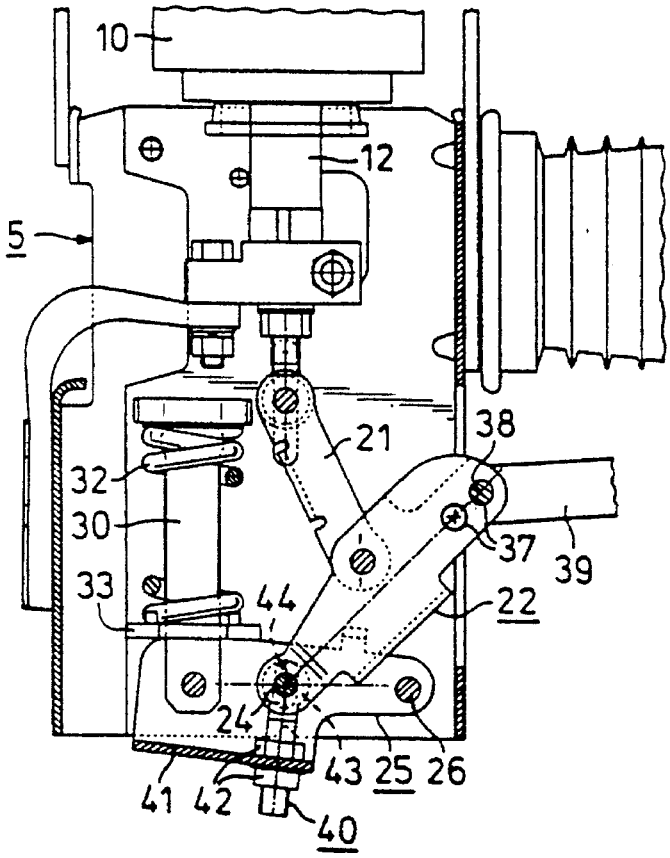
Figure 3:
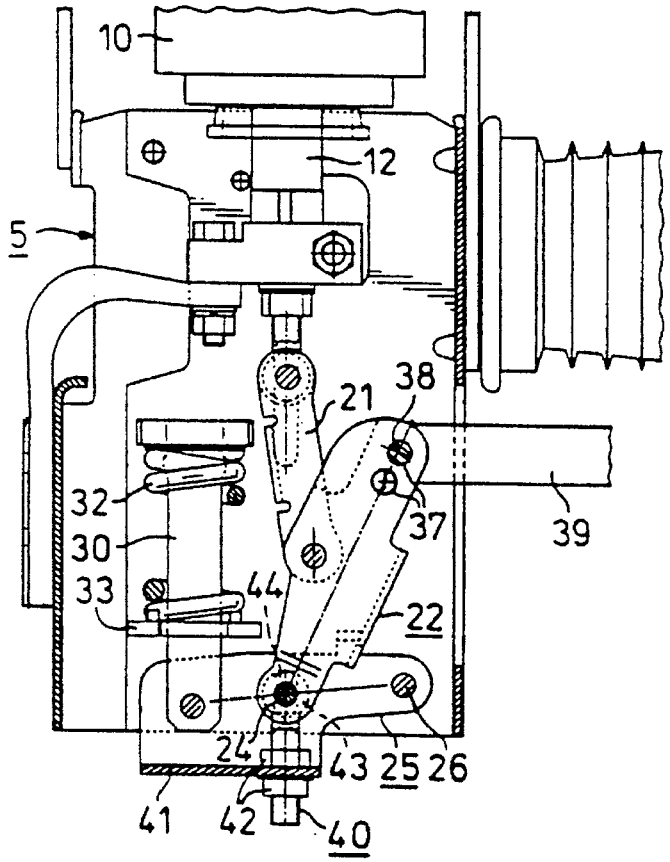

The invention will be explained in greater detail below with reference to the exemplary embodiment illustrated in the figures, in which:

FIG. 1 shows a pole of a multi-pole vacuum switch with a pole operating unit in a side view, FIGS. 2 and 3 show in a view which is enlarged in comparison with FIG. 1 a pole operating unit with adjoining parts.

Figure 4:
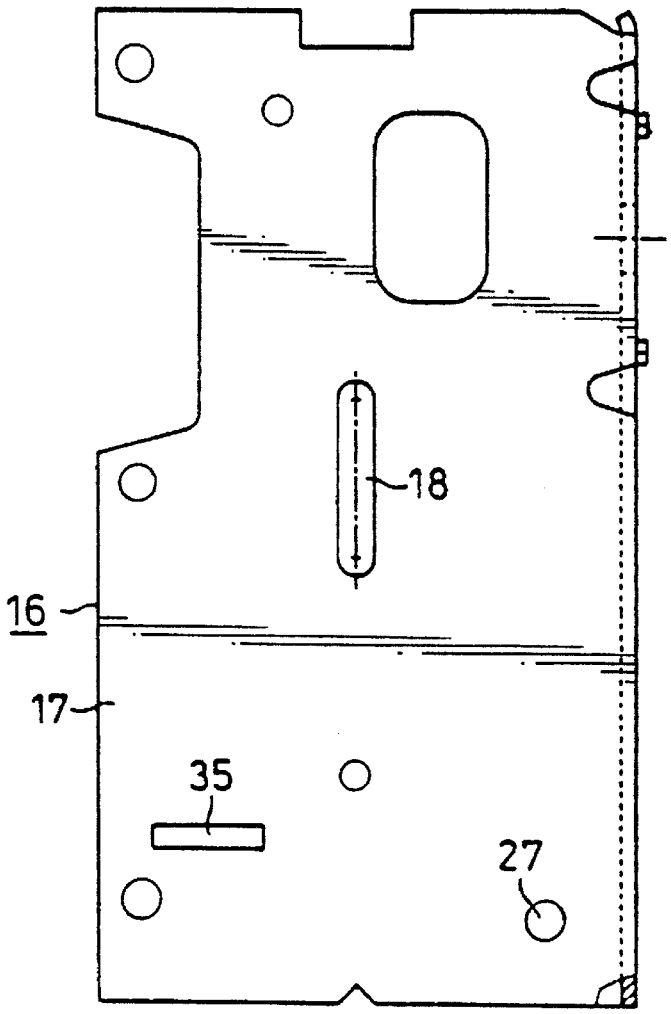
Figure 5:
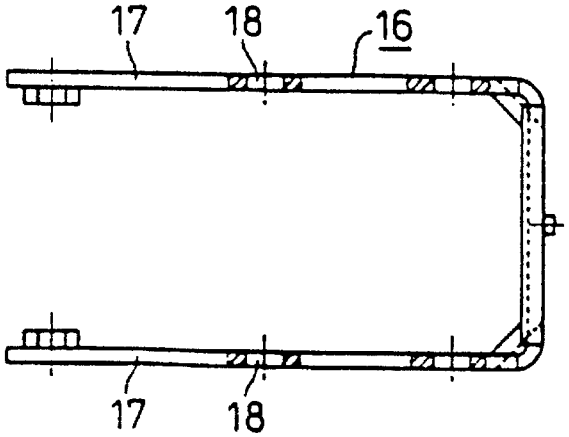

In FIGS. 4 and 5 a casing of a pole operating unit is illustrated as a single part in two views.

The vacuum circuit-breaker 1 shown in FIG. 1 comprises, as essential assemblies, a box-shaped casing 2 with a drive device 3 which is located therein and indicated by broken lines, switching poles 4 with in each case one pole operating unit 5 and support insulators 6 for the insulated connection of the switching poles 4 to the casing 2. Because the circuit breaker 1 is illustrated in a side view, only one of the switching poles 4 is visible in FIG. 1.

Each switching pole 4 contains a vacuum switching tube 10 which extends with a vertical longitudinal axis between one pole head 11 and the pole operating unit 5 of the respective switching pole 4. Details of the vacuum switching: tube 10 are not illustrated since any desired suitable switching tube can be used. In a known manner, the switching elements of the vacuum switching tube 10 which are not shown can be closed and opened by a linear movement of a lower connection bolt 12 which protrudes into the pole operating unit 5. In this arrangement, the fixed switching element of the vacuum switching tube 10 is connected to an upper connection rail 13 via the associated connection bolt and a clamping device whilst the movable switching element is connected to a lower connection rail 15 also via a clamping device and a flexible connector 14.

The design of the pole operating unit 5 is described in greater detail below. The pole operating unit 5 has a casing 16 with a U-shaped cross section which is shown as a single component in FIG. 4 in a side view corresponding to FIG. 1, and is shown in top view in FIG. 5. Elongated holes 18 are arranged in parallel legs 17 of the casing 16 and serve to guide an articulation bolt 20 which connects the movable connection bolt 12 of the vacuum switching tube 10 to an upper toggle lever 21 (FIG. 1 ). A lower toggle lever 22 is connected to the upper toggle lever 21 by means of a toggle joint bolt 23 and is connected at its other end, also in an articulated fashion, to a supporting lever 25 by means of a connection bolt 24. A bearing pin 26 which extends through openings 27 in the legs 17, lying opposite, of the casing 16 serves as pivot bearing of the supporting lever 25. At its end lying opposite the bearing pin 26, the supporting lever 25 is connected by a further articulation bolt 28 to a pull rod 30 which bears at the end lying opposite a counter-bearing 31 for supporting a contact force spring 32 constructed as a helical compression spring. The pull rod 30 extends through an opening in a transverse element 33 which is provided with pins 34 which engage in rectangular openings 35 of the legs 17 of the casing 16 (FIG. 4). The lower toggle lever 22 has a protruding lever part 36 which projects beyond the toggle joint bolt 23 and is provided with two through-openings 37 for the optional insertion of a coupling bolt 38. In FIG. 1, an insulating coupling rod 39 is shown which connects the indicated drive device 3 to the lever part 36.

The mode of operation of the pole operating unit 5 is clarified by FIGS. 2 and 3 in which, in a view corresponding to FIG. 1, only the pole operating unit 5 with the adjoining parts is shown. In the state of rest according to FIG. 2, which corresponds to the switchedoff position of the vacuum switching tube 10, the supporting lever 25 rests at its end lying opposite the bearing pin 26 on the transverse element 33 with a pretensioning provided by the contact force spring 32. The toggle levers 21 and 22 are in a bent-out position. The angle between the toggle levers 21 and 22 depends on an adjustment device which is arranged between the lower toggle lever 22 and the supporting lever 25. As can be seen in greater detail in FIG. 2, the adjustment device comprises an eye bolt 40 whose threaded shaft penetrates a central part 41 of the supporting lever 25 with a U-shaped cross section. Nuts 42 on both sides of the central part 41 permit the position of the eye part 43 of the eye bolt 40 to be adjusted relative to the central part 41. The connection bolt 24 penetrates the lower end of the lower toggle lever 22 and elongated holes 44 in the legs of the supporting lever 25. By means of the adjustment device, it is possible to determine the maximum displacement which can be covered starting from the position of the toggle levers 21 and 22 in FIG. 2 as far as their position according to FIG. 3.

If the drive device 3 (FIG. 1) is released for switching-on, the operating force is transmitted via the insulating coupling rod 39 to the lever part 36. Depending on which of the through-openings 37 of the coupling bolts 38 is used for the coupling rod 39, a larger or smaller transmission ratio is obtained with the same rotary angle of the switch shaft. During the movement of the toggle levers 21 and 22 in the direction of the extended position, the articulation bolt 20 slides in the elongated holes 18 with simultaneous displacement of the connection bolt 12 and of the movable switching element which is connected thereto and located inside the vacuum switching tube 10. If the switching elements are closed, the supporting lever 25 is pivoted in an anti-clockwise direction and, during this process, lifted off from the transverse element 33. As a result, the contact force is applied between the switching elements as a result of tensioning of the contact force spring 32 by means of the pull rod 30. In the switched-on position according to FIG. 3, the toggle levers 21 and 22 are just in front of their extended position. The insulating coupling rod 39 and the drive device 3 connected thereto are therefore largely relieved of the contact force. It is expedient for there to be provision that the toggle levers 21 and 22 only approach the extended position to the extent that the remaining force acting on the coupling rod 39 is certain to be sufficient, after the enabling of the drive device 3, to induce the switching-off process without delay in order to bring about switching off.

As is shown by the figures, the adjustment device consisting of the eye bolt 40 and the nuts 42 is easily accessible on the underside of the pole operating unit 5. Therefore, no difficulties are experienced in performing an adjustment of the toggle lever arrangement on the ready-mounted power circuit-breaker 1. The contact force spring 32 is supported on one side on the transverse element 33 so that during switching not all of its mass is moved along. This avoids the tendency for natural vibrations to occur and reduces the operating force to be applied in comparison with known arrangements in which the contact force spring is arranged in the course of the force-transmitting means.

We claim:

1. In a multi-pole vacuum switch with a vacuum switching tube which has a linearly movable operating plunger for each pole, a pole operating unit assigned to each vacuum switching tube provided with an operating force from a drive device common to all poles, the pole operating unit comprising:

a) a contact force spring, said contact force spring being arranged approximately parallel to a direction of movement of the operating plunger;

b) a casing, said casing supporting said contact force spring;

c) a lever arrangement, said lever arrangement i) being supported by said casing, ii) adapted to change the direction of the operating force provided by the drive device on the operating plunger, and iii) including an upper toggle lever, a lower toggle lever, and a supporting lever, said upper toggle lever being connected, in an articulated fashion, to the operating plunger of the vacuum switching tube, said lower toggle lever being connected, in an articulated fashion at one end to said supporting lever, and further being connected at a second end to the drive device, said lower toggle lever also being connected to said upper toggle lever, wherein said supporting lever is pivotally mounted to the casing at a first end and is connected to said contact force spring at a second end, said supporting lever assuming in its position of rest when the vacuum switch is open, a position that is approximately at right angles to the direction of movement of the operating plunger, and said upper and lower toggle levers being almost maximally extended when the vacuum switch is closed.

2. The vacuum switch of claim 1 further comprising an insulating coupling rod having a first end coupled with said drive device and a second end, wherein said lower toggle lever is connected with said supporting lever, and wherein said upper toggle lever is connected at a central portion of said lower toggle lever with a toggle joint bolt thereby defining a protruding lever portion of said lower toggle lever which extends beyond said toggle joint bolt, said protruding lever portion providing a coupling point at which said second end of said insulating coupling rod is connected, whereby said insulating coupling rod connects the drive device to the pole operating unit.

3. The vacuum switch of claim 2, wherein said protruding lever portion has at least two through-openings arranged at different distances from an end of said lower toggle lever, said second end of said insulating coupling rod being connected to said protruding lever portion at one of said at least two through-openings by means of a coupling bolt.

4. The vacuum switch of claim 1 further comprising an eye bolt having an eye part, and nuts which determine the position of the eye part of the eye bolt, wherein said supporting lever is provided with an elongated hole within which said eye part of said eye bolt is positioned, an articulated connection bolt connecting said lower toggle lever to said supporting lever at an adjustable position determined by said nuts of said eye bolt.

5. The vacuum switch of claim 1 further comprising:

d) a pull rod, said pull rod having a head at a first end, said head abutting a first end of said contact force spring and having a second end coupled with said supporting lever; and e) a transverse element, said transverse element being arranged in said casing of the pole operating unit, providing a counter-bearing of said supporting lever when said vacuum switch is opened, providing a counter-bearing for a second end of said contact force spring, said contact force spring being a helical compression spring, and being provided with a through-opening for said pull rod.

* * * * *